United States Patent [19]

Leslie

[11] Patent Number: 4,513,895

[45] Date of Patent: Apr. 30, 1985

[54] FLEXIBLE INSULATIVE CARRIER

[76] Inventor: Peter C. Leslie, 123 S. Justison St., Wilmington, Del. 19801

[21] Appl. No.: 588,212

[22] Filed: Mar. 12, 1984

Related U.S. Application Data

[63] Continuation-in-part of Ser. No. 404,220, Aug. 2, 1982, abandoned.

[51] Int. Cl.[3] ..... A45C 9/00

[52] U.S. Cl. ..... 224/151; 220/3.1; 224/259

[58] Field of Search ..... 383/4, 110, 119; 220/3.1; 224/259, 260, 153, 151, 148; 150/52 R; 215/12 A, 13 R

[56] References Cited

U.S. PATENT DOCUMENTS

| | | | |
|---|---|---|---|
| 1,723,731 | 8/1929 | Hafling | 224/148 X |
| 1,949,677 | 3/1934 | Crawford | 215/12 A |
| 1,986,743 | 1/1935 | Musick | 383/119 X |
| 2,139,895 | 12/1938 | Hosselkus | 383/119 X |
| 2,464,069 | 3/1949 | Benson | 150/2.2 |
| 2,731,182 | 1/1956 | Higgins | 383/110 X |
| 2,733,710 | 2/1956 | Zibell | 150/2.2 X |
| 3,032,224 | 5/1962 | Lou | 215/13 R |
| 3,120,319 | 2/1964 | Buddrus | 215/13 R |
| 3,549,064 | 12/1970 | Wilson | 224/151 |
| 3,923,222 | 12/1975 | Groves | 224/250 X |
| 4,109,692 | 8/1978 | Brown | 150/52 R |
| 4,197,890 | 4/1980 | Simko | 150/2.2 |
| 4,228,908 | 10/1980 | Tweeton | 224/148 X |
| 4,273,274 | 6/1981 | Freistadt | 224/151 X |

*Primary Examiner*—Stephen Marcus
*Assistant Examiner*—Robert Petrik
*Attorney, Agent, or Firm*—Norman B. Rainer

[57] ABSTRACT

A thermally insulative carrier is provided comprised of a container fabricated of a closed cell foam of a resilient polymer, a harness adapted to lie in close-fitting contact with the exterior of the container, and an exterior cloth jacket which is sewn to the harness. Because of the manner of attachment of the jacket to the harness, the jacket is placed under less localized stress by the weight of the container and its contents. The jacket is provided with a closure panel and carrying straps.

12 Claims, 4 Drawing Figures

FLEXIBLE INSULATIVE CARRIER

BACKGROUND OF THE INVENTION

This is a continuation-in-part application based upon application Ser. No. 404,220, filed 08/02/82, now abandoned.

This invention relates to an improved thermally insulative container which is flexible and adapted to be carried as a backpack unit.

The use of portable ice chests of rigid construction is well known, said chests generally utilizing a foamed plastic such as polystyrene as the thermal insulating material. Because of their rigid construction, they occupy relatively large space, and cannot accommodate to smaller or differently shaped spaces. When suitably reinforced by means of a heavy and costly metal shell, said rigid chests may be utilized as seats or stepping stools, but generally lack further functionality. Because of the generally poor compressive and tear strength of foamed polystyrene, insulated chests fabricated therefrom have low life expectancy unless metal-jacketed as aforesaid. Since few rigid insulated containers are provided with a leak-proof lid, they are generally constrained to storage and transportation in an upright mode only.

Containers for the protective shipment of fragile bottles are well known. For example, U.S. Pat. No. 2,464,069 to Benson discloses a container for carrying glass bottles in upright position. The container is comprised of an elongated leak-proof fabric bag closeable by a drawstring, and separate rigid bottom and resilient sidewall pieces for removable insertion within said bag. The Benson carrier therefore does not appear suitable for use for thermally insulative purposes. Neither is it adapted for use as a backpack which may be worn in a horizontal position.

U.S. Pat. No. 3,120,319 to Buddrus, like the Benson patent, concerns a rigid-walled container designed to prevent breakage of a single glass bottle for which the container is specially shaped.

It is accordingly an object of the present invention to provide a flexible thermally insulative container specially adapted for camping and other outdoor uses.

It is another object of this invention to provide a container of the aforesaid nature adapted to be carried in the manner of a backpack and in other carrying styles.

It is a further object of the invention to provide a container of the aforesaid nature having leak-proof closure means.

It is a still further object of this invention to provide a container of the aforesaid nature which may be utilized as a flotation safety device.

It is yet another object of the invention to provide a container of the aforesaid nature which, when suitably filled, can serve as a stool for seating or step-up purposes.

Another object is to provide a container of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved thermally insulated carrier comprising:

(a) a container having a cylindrical wall, a fixed bottom closure and a removable, tight-fitting lid, fabricated entirely of a closed cell foam of a resilient polymer, (b) a harness comprised of strong, wide webbing adapted to lie in close-fitting contact with the exterior of said cylindrical wall and fixed bottom closure, and (c) an exterior cloth jacket adapted to encompass said container and harness in close-fitting engagement therewith, said jacket having a closure panel and being attachedly sewn to said harness and provided with fittings for attachment of carrying straps.

The preferred material for fabrication of the container is closed cell neoprene slab stock having a thickness between about $\frac{3}{4}''$ and 2". The slab stock is formed into the desired cylindrical wall shape by heat sealing or adhesive bonding of two abutting edges along a substantially straight line parallel to the longitudinal center axis of the cylindrically shaped wall. The fixed bottom closure is emplaced preferably by adhesive bonding. Useful adhesives are generally comprised of saturated solutions of neoprene in volatile organic solvents such as aromatic and halogenated hydrocarbons. The container is capable of bending to some extent with respect to its longitudinal axis, thereby permitting conformational adjustment for greater carrying comfort in backpack style.

Particularly preferred types of closed cell neoprene slab stock for securing the sought objectives of this invention will have a density between 4.5 and 8.5 pounds per cubic foot, a K factor between about 0.26 and 0.29 BTU-in./hr. ft.$^2$ ° F., and a compressive deflection between 2 and 5 pounds per square inch pursuant to ASTM test method D-1056.

The interior of the container is impervious to liquids. Such imperviousness may be secured by virtue of the nature of the interior surfaces of the materials from which the container is constructed. In addition, however, a separate thin plastic bag may be utilized as an easily removable liner within the container. The liner protects the interior walls of the container from contamination by food or other contents of the container, thereby minimizing the need for cleaning of said interior walls. The liner may be a durable component of the insulated container, and attached thereto by a zipper which joins the mouth of the liner to the mouth of the container, or the liner may be of a disposable nature.

The closure panel of said jacket is substantially circularly shaped of fabric and attached to the jacket adjacent the upper extremity thereof. Adjustable fastening means such as a zipper, snaps or Velcro material enable the closure panel to be easily placed in its open or closed mode. The jacket may further be provided with an internally disposed apron and associated drawstring which permit sealing of the upper extremity of the jacket when the container is absent, or embracing the lid of the container to more assuredly hold it fast to the underlying cylindrical wall. The closure panel of the jacket may be provided with a stiff fabric retaining shoulder adapted to grip the lid of the container and thereby hold the lid when it is removed from the container.

The carrier can be carried in vertical or horizontal disposition as a backpack, and can serve as a pillow, ice chest, emergency flotation device, weatherproof container, and, when suitably packed, as a padded stool.

Because the jacket is attached to the harness, which removably embraces the container, the jacket-harness subcombination finds separate utility as a duffle bag which can be carried in the manner of a backpack or in other modes.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
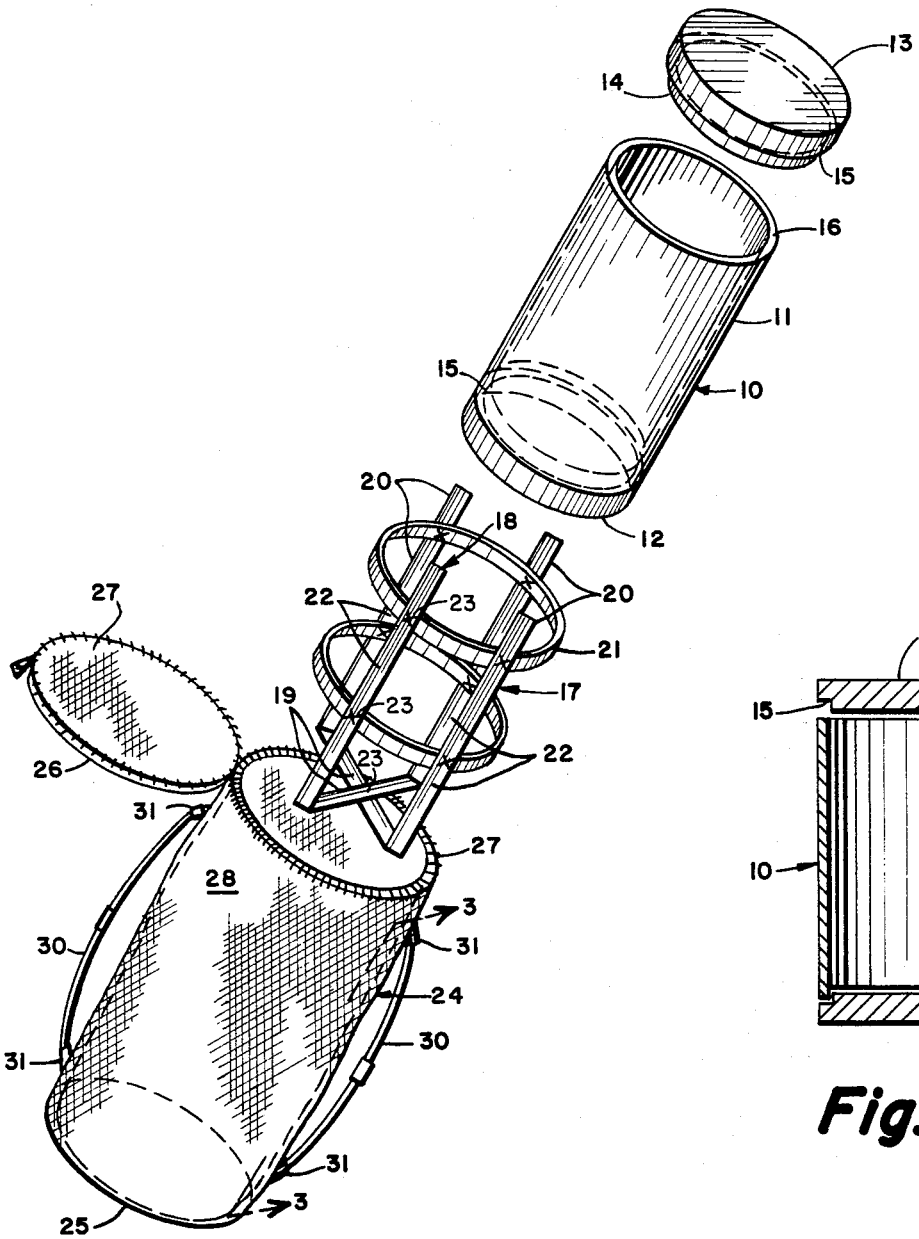
FIG. 1 is an exploded perspective view of an embodiment of the flexible insulative carrier of this invention.
Figure 2:
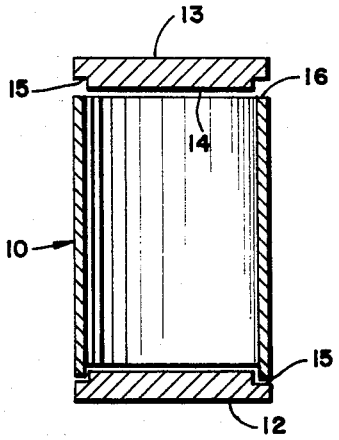
FIG. 2 is a sectional side view of the container member of the flexible insulative carrier of this invention.

Referring to FIG. 1, an embodiment of the flexible insulative carrier of the present invention is shown comprised of container 10 having circular cylindrical wall 11 and fixed bottom closure 12. A removable lid 13 having a circular diameter equal to the outer diameter of cylindrical wall 11, is provided with an indented portion 14 adapted to insertively fit within the open upper extremity of said container in tight-fitting engagement therewith. A flat ring-like shoulder 15 fits in abutment with the upper flat edge 16 of the cylindrical wall.

The cylindrical wall, bottom closure and lid are preferably all fabricated of Rubatex, a closed cell neoprene foam manufactured as slab stock by the Rubatex Corporation of Bedford, Virginia. Other equivalent closed cell resilient materials may however by used. The thickness of the wall is 0.75" to 1.0", and the thickness of the bottom and lid is 1.5" to 2.0". The greater thickness of the bottom and lid, compared to the wall, imparts greater structural stability and strength to the container without significantly diminishing its capability of sustaining flexible deformations. The cylindrical wall is formed by adhering together the mitered edges of a piece of flat slab stock so as to form a bonded seam running parallel to the center longitudinal axis of the container. The bottom closure is shaped similarly to the lid but is bonded in place with adhesive applied around shoulder 15 and indented portion 14 to form a water impervious seal.

Although the dimensions of the container may be varied to suit particular uses, an examplary embodiment utilizes a container having an inside height of 18 ½", an inside diameter of 11", and an outside circumference of 38". A container of such dimensions will have a 19.87 liter capacity. In general, the ratio of inside height to inside diameter of the container will range between about 1.5 and 1.8. Containers of such configuration afford the sought features and advantages of this invention. In particular, the configuration delineated by said ratio of height to diameter enables the carrier to function as a stool. Values of the ratio greater than about 1.8 not only render the carrier unsuitable as a stool but cause difficulty in retrieving items stored in the lowermost part of the container. Values of the ratio smaller than about 1.5 cause the perimeter of the lid to be disproportionately large in comparison to the volume of the container, thereby engendering potential inefficiency in thermal insulation. Additionally, it has been found that container configurations having a ratio smaller than about 1.5 are difficult to carry in backpack fashion because of the shorter axis of elongation along which conformational bending has been found desirable.

The thickness and resiliency of the cylindrical wall, in conjunction with the geometrical shape and size of the container are chosen such that the container when empty can be compressed in the direction perpendicular to said axis to an extent that the spacing between the opposing wall surfaces will be less than 50% of the uncompressed inside diameter. Because of the deformability of the container, it can adapt to varied storage requirements and can be utilized as a pillow or seat cushion in camping expeditions.

Harness member 17 is comprised of two U-shaped straps 18 having opposed long portions 22 of substantially equal length which extend straightly in perpendicular orientation to flat bottom portion 19. The U-shaped straps are disposed such that bottom portions 19 are in perpendicularly crossing juxtaposition at their midpoints while long portions 22 are parallel and oriented in the same direction such that their extremities 20 are substantially coplanar.

Two circular straps 21, in spaced-apart parallel relationship, perpendicularly cross long portions 22 at sites equally spaced about said circular straps.

The straps are preferably fabricated of 100% nylon or polypropylene webbing, tight weave, 2" wide. Suitable straps are those generally utilized as seat belt restraint systems in automobiles and aircraft. The aforesaid sites of crossing of the straps of the harness member are designated by numeral 23 in FIG. 1. At said sites of crossing, nine in number when using two U-shaped and two circular straps, the straps are sewn together preferably using reinforced nylon thread in a double box X pattern.

The interior dimensions of the harness member are such as to facilitate snug-fitting accommodation of the container member. The primary purpose of the harness member is to uniformly transfer the weight of the container and contents to the jacket. The harness member further secures the container while providing attachment means for the jacket, as will hereinafter be shown.

The jacket member 24 is the exterior component of the insulative carrier of this invention. The jacket is preferably made of a strong lightweight fabric comprised of nylon, polyester or other durable synthetic fiber. The fabric is preferably washable, mildew proof, non-absorbent, shrink-resistant, and stain-resistant. Some embodiments of the fabric utilized for the jacket may also be rendered impervious to water.

The jacket member is contoured in a manner to closely fit around the insulated container. The bottom 25 of the jacket member, namely that portion in contact with the bottom of the container, is preferably of double fabric thickness for longer wear. The jacket member is provided adjacent its upper extremity with closure panel 26 attached by zipper means 27 to sidewall portion 28. The zipper and its slide are preferably fabricated of nylon or other durable plastic material. Zipper means 27 is of circular configuration, and of a selfrepairing design, and is stitched to closure panel 26 and sidewall 28 with reinforced nylon thread. The jacket member may be formed from flat fabric stock by forming a straight seam along the sidewall, and a circular seam connecting the bottom of the sidewall to bottom portion 25.

Figure 4:
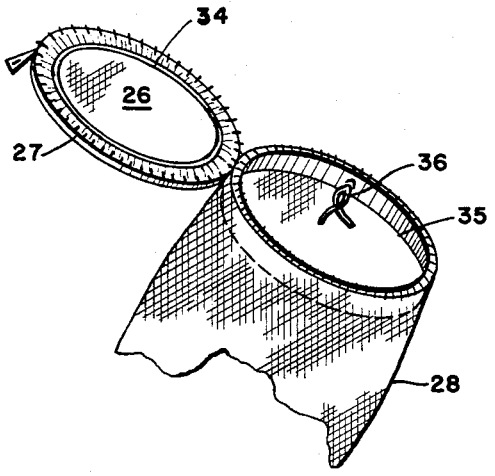
FIG. 4 is a fragmentary perspective view of an embodiment of the jacket member provided with apron and drawstring, and a closure panel having a retaining shoulder.

In the embodiment illustrated in FIG. 4, closure panel 26 of said jacket is provided with a stiff fabric retaining shoulder 34 adapted to engage removable lid 13 of the container. An apron 35 is positioned within the jacket adjacent its upper extremity and provided with drawstring 36.

The harness member prevents localized stresses from concentrating in the fabric of the jacket member when the unit is carried with a heavy cargo. For example, if the insulative carrier were to be worn as a backpack with the long axis in the vertical position, the weight of the carrier plus its contents would eventually tear the seam which attaches the bottom portion of the jacket if it were not for the redistribution of force achieved by the harness member.

Figure 3:
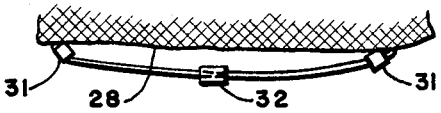
FIG. 3 is a side view of carrying strap means associated with the exterior of the jacket member of the insulative carrier of this invention.

Paired carrying straps 30 are affixed to the exterior of the sidewall of the jacket member by removable engagement with anchor means 31 sewn to said sidewall. As shown more clearly in FIG. 3, said carrying straps, which are preferably fabricated of 1 ½" wide nylon fabric webbing, are equipped with a keeper slide 32 adapted to adjust the size of the loop of the carrying strap. The paired carrying straps are intended primarily as shoulder straps which enable the carrier to be carried on a person's back with the longitudinal axis of the container in vertical orientation.

An important feature of the present invention is that anchor means 31 are sewn to the sidewall of the jacket in a manner such that the sewn engagement penetrates into a crossing site 23 of the harness member. There are two major consequences of this critical feature: A) the harness, jacket and carrying straps are caused to form a subcombination unit which is useful as a duffle bag when removed from the insulative container, and B) the communication of the carrying straps with the crossing sites of the underlying harness causes re-distribution of stresses which would otherwise localize and tear the jacket fabric under heavy loads. Anchor means 31 are preferably short pieces of belting fabric forming a loop which may accommodate a dee ring. Attachment of the carrying straps to said anchor means or dee ring associated therewith may be by way of conventional spring-closed hooks.

Other carrying straps may be provided on the exterior of sidewall portion 28 to facilitate other modes of gripping and carrying the device. Pockets may also be provided on the exterior of sidewall portion 28, said pockets being sealable by Velcro fasteners. Where the various straps and belts employed in the device of this invention are comprised of thermoplastic polymeric fibrous material, the ends are preferably heat-sealed so as to prevent fraying or unraveling. The jacket may be provided with decorative indicia which may have ornamental or advertising value or may serve, as in the case of the international orange color, to enhance visual identification.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. An improved thermally insulated carrier comprising:

(a) a container having a circular cylindrical wall, a fixed bottom closure and a removable, tight-fitting lid, fabricated entirely of a closed cell foam of a resilient polymer, (b) a harness comprised of strong, wide webbing adapted to lie in close-fitting contact with the exterior of said cylindrical wall and bottom closure, said webbing crossing at several sites, and interengaged at said sites of crossing, (c) a cloth jacket adapted to encompass said container and harness in close-fitting engagement therewith, said jacket comprising a sidewall portion made from flat fabric by forming a straight seam, and a flat bottom portion joined to the sidewall portion by a circular seam, (d) anchor means disposed upon the exterior of the sidewall portion of said jacket in sewn engagement with said jacket and said harness, and (e) a pair of carrying straps adapted to engage said anchor means, (f) whereby said carrier is adapted to be carried in the manner of a backpack, and the subcombination comprising the harness, jacket and carrying straps finds separate utility as a duffle bag.

2. The carrier of claim 1 wherein said resilient polymer is neoprene.

3. The carrier of claim 1 wherein said jacket is provided with a zipper-attached closure panel adjacent its upper extremity.

4. The carrier of claim 1 further comprising a removable water-impervious liner adapted to reside within said container.

5. The carrier of claim 2 wherein the thickness of said cylindrical wall is between 0.75 and 1.0 inch, and the thickness of the lid and bottom closure are between about 1.5 inch and 2.0 inch.

6. The carrier of claim 2 wherein the ratio of the inside height to inside diameter of said container is between about 1.5 and 1.8.

7. The carrier of claim 1 wherein said closed cell foam has a density between 4.5 and 8.5 pounds per cubic foot, a K factor between about 0.26 and 0.29 BTU-in/hr. ft.$^2$ ° F., and a compressive deflection between 2 and 5 pounds per square inch pursuant to ASTM test method D-1056.

8. The carrier of claim 1 wherein said container is impervious to water.

9. The carrier of claim 1 wherein the thickness and resiliency of the cylindrical wall, in conjunction with the geometrical shape and size of the container are such that the container when empty can be restorably compressed in the direction perpendicular to the axis of said cylindrical wall to an extent that the spacing between the opposing wall surfaces will be less than 50% of the uncompressed inside diameter.

10. The carrier of claim 1 wherein the sewn engagement of the anchor means with said harness is at said sites of crossing.

11. The carrier of claim 10 wherein the harness is comprised of at least two U-shaped portions of webbing having opposed parallel portions of substantially equal length extending in perpendicular orientation to the flat bottom portion of said jacket, and at least one circular strap which perpendicularly crosses said parallel portions.

12. The carrier of claim 11 wherein said anchor means are comprised of fabric and contain a loop.

* * * * *